United States Patent [19]

McGarvey

[11] Patent Number: 5,069,369

[45] Date of Patent: Dec. 3, 1991

[54] METHOD AND ASSEMBLY FOR RETAINING A MOUNTING CUP WITH A SEALING COLLAR

[75] Inventor: Glenn W. McGarvey, Watertown, Conn.

[73] Assignee: Risdon Corporation, Naugatuck, Conn.

[21] Appl. No.: 485,976

[22] Filed: Feb. 27, 1990

[51] Int. Cl.[5] ..... B05B 11/00; B67D 5/42

[52] U.S. Cl. ..... 222/321; 215/274; 215/277; 222/385; 222/542

[58] Field of Search ..... 222/321, 383, 385, 372, 222/542; 215/247, 274, 277, 324

[56] References Cited

U.S. PATENT DOCUMENTS

| | | | |
|---|---|---|---|
| 2,175,350 | 10/1939 | Hammer | 215/277 |
| 3,823,840 | 7/1974 | Zackheim | 215/274 X |
| 3,912,102 | 10/1975 | Michel | 215/324 X |
| 4,113,145 | 9/1978 | Meshberg | 222/321 X |
| 4,147,476 | 4/1979 | Warren | 222/321 X |
| 4,274,560 | 6/1981 | Cater | 222/321 |
| 4,606,479 | 8/1986 | Van Brocklin | 222/321 |
| 4,676,407 | 6/1987 | Rideout | 222/182 |
| 4,735,347 | 4/1988 | Schultz | 222/321 |
| 4,773,553 | 9/1988 | Van Brocklin | 215/272 |

*Primary Examiner*—Kevin P. Shaver

*Attorney, Agent, or Firm*—St. Onge Steward Johnston & Reens

[57] ABSTRACT

The assembly comprises a sealing collar and a mounting cup which is slidable through a path of movement over a container flange to an assembled position with the cavity retaining the sealing collar therein. The skirt has an inner sidewall that has a circumferentially extending groove formed therein for snappingly engaging the collar perimeter when the collar is inserted axially into the cavity, whereby the collar and pump body are lockingly retained in combination with the cup by the cooperation of the groove with the collar perimeter.

11 Claims, 4 Drawing Sheets

94
10
104
98
102
80
104
10
94
88
86
92

78

76
74
34
68
30
72
118
82
88
80

52
60
58
56
34
4
64
70
63
30
10

100
90
84
9
9
82
96
96
98
102
80

METHOD AND ASSEMBLY FOR RETAINING A MOUNTING CUP WITH A SEALING COLLAR

FIELD OF THE INVENTION

The present invention relates to a method and assembly for retaining a mounting cup with a sealing collar preparatory to using the cup and collar for mounting a dispenser such as a pump body to a flanged container. More particularly, the present invention relates to a method and an assembly for reducing the likelihood that a mounting cup and sealing collar combination will become separated before use in production.

BACKGROUND OF THE INVENTION

It is often desirable to secure a pump, a valve, or other dispensing means to a container storing a liquid product. A typical container may be made of glass and have a neck with an opening for dispensing the product, with a flange included around the opening. For example, U.S. Pat. No. 4,606,479 issued Aug. 16, 1989 to Van Brocklin discloses one prior art assembly for securing and sealing a dispenser to a flanged container.

In the typical application, a generally disc-shaped resilient sealing collar made of a polymeric material surrounds the barrel of an elongated pump body or other dispenser which is to be mounted in an opening in the container. The container has a neck surrounded by a flange having a flange upper surface for mating in a sealing relationship with said collar, a flange sidewall, and a ledge at the bottom of said flange. A mounting cup fits over the sealing collar, and the cup has a skirt that extends down over the collar and flange.

In the typical assembly production situation, a mounting cup is one separate workpiece, while the pump body with sealing collar attached about the barrel thereof is another separate workpiece. The collar is positioned into said cup in a semi-assembled position and shipped in said position prior to use in production, and each cup-collar combination is used one at a time in a container sealing operation.

One disadvantage of such an arrangement is that during routine shipping and handling the mounting cup often pulls apart and becomes separated from the sealing collar-pump body assembly before it can be used in production. Since either the cup or collar is ineffective without a matching mate, time is undesirably consumed in reassembling the combination for use in the sealing process. This of course introduces an undesirable inefficiency into the manufacturing process.

SUMMARY OF THE PRESENT INVENTION

In accordance with the preferred embodiment of the present invention, a mounting cup is provided with a groove on a radially inward sidewall thereof for interlockingly engaging an outer perimeter of a sealing collar in a locking relationship to retain the cup and collar together prior to the assembly step. The sealing collar has an outer diameter that is slightly greater than the inner diameter of the mounting cup, so that when the collar is pressed into the cup a sufficient axial distance to encounter said groove, the collar interlocks with the groove at its outer perimeter and is retained thereby.

Also in accordance with the preferred embodiment of the present invention, a punch and plunger set is provided for forming the groove of the present invention in the mounting cup. The punch is a cylindrical member for fitting into the mounting cup before the sealing collar is inserted. The punch is hollow at one end thereof and has a circumferentially extending blade on the radially outward side thereof corresponding in shape and dimension to the groove to be formed in the cup. A plunger is inserted into the hollow end of the punch, the plunger having on the radially outward side thereof a tapered camming surface for engaging the radially inward punch sidewall opposite from said blade. After the punch is positioned inside the cup, the plunger is urged axially inward of the punch such that said camming surface spreads said punch apart and the blade imprints the sidewall of the cup. An annular anvil is placed around the radially outward side of the mounting cup to provide a surface against which the blade reacts to press the groove into the cup sidewall.

In accordance with one aspect of the invention the groove is visible only from the inner side of the mounting cup and the appearance of the outer side of the mounting cup is a continuous flush surface.

It is an object of the present invention to provide a mounting cup-sealing collar combination that remains reliably in a semi-assembled form until use in production for mounting to a flanged container.

It is a further object of the present invention to provide a method for providing a mounting cup-sealing collar combination that resists annoying separation prior to use in mounting to a flanged container.

It is a further object of the present invention to provide a punch and plunger set for use in impressing a groove into the radially inward sidewall of a mounting cup to enable said cup to snappingly receive said sealing collar therein to retain said sealing collar with said cup in a semi-assembled state prior to assembly onto a container. It is a further object to provide a mounting cup with a continuous flush outer surface.

Further objects and advantages of the present invention will become apparent from the following description of the drawings and the preferred embodiments.

DETAILED DESCRIPTION OF THE PREFERRED EMBODIMENT

Figure 1:
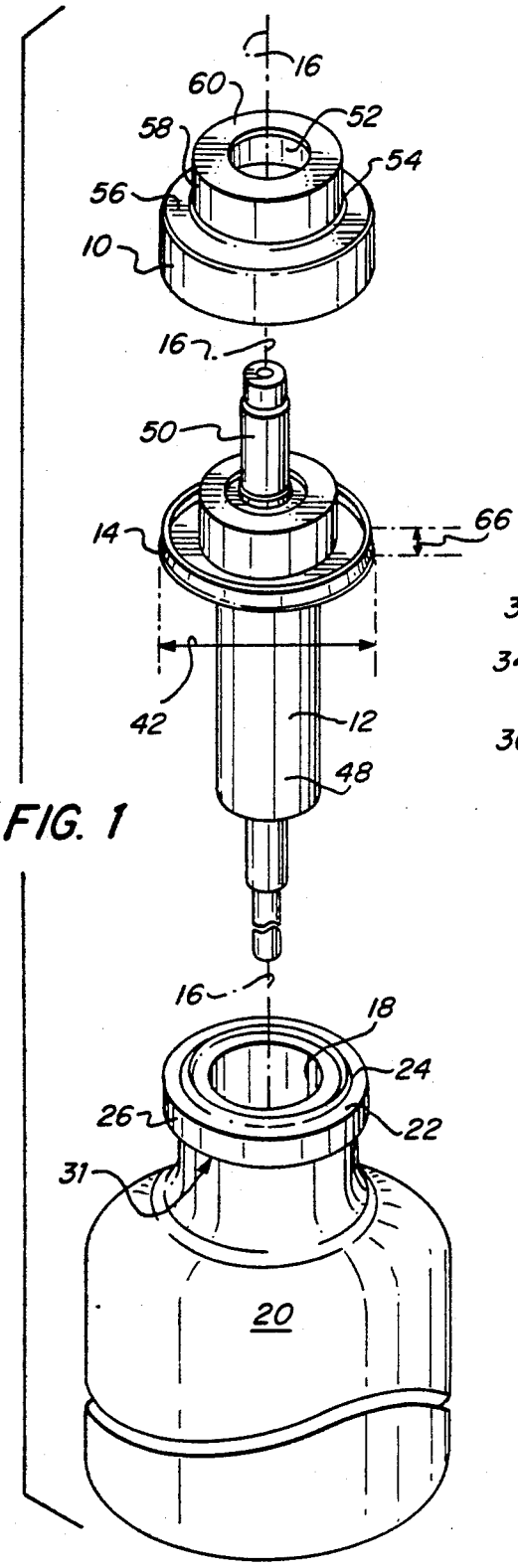
FIG. 1 is an exploded isometric view of the mounting cup and pump body with sealing collar before assembly onto a container.

With reference now to FIG. 1, mounting cup 10 of the present invention fits around pump body 12 which has associated therewith a sealing collar 14 securely affixed thereto such as by gluing, by being formed integrally therewith, or by other conventional means. Cup 10 and collar 14 with pump body 12 are assembled along central axis 16 into opening 18 of container 20, which opening 18 is surrounded by flange 22 having upper flange surface 24 for mating with collar 14 in a sealing relationship, flange sidewall 26 for abutting the radially inward sidewall 28 of skirt 30 of cup 10, and downwardly facing ledge 31 of flange 22. The mounting cup 10 can be used with a wide variety of dispensing devices including pumps, shaker valves, and containers with tops and is suitable for use with the pump disclosed in U.S. Pat. No. 4,606,479 to Van Brocklin.

Figure 2:
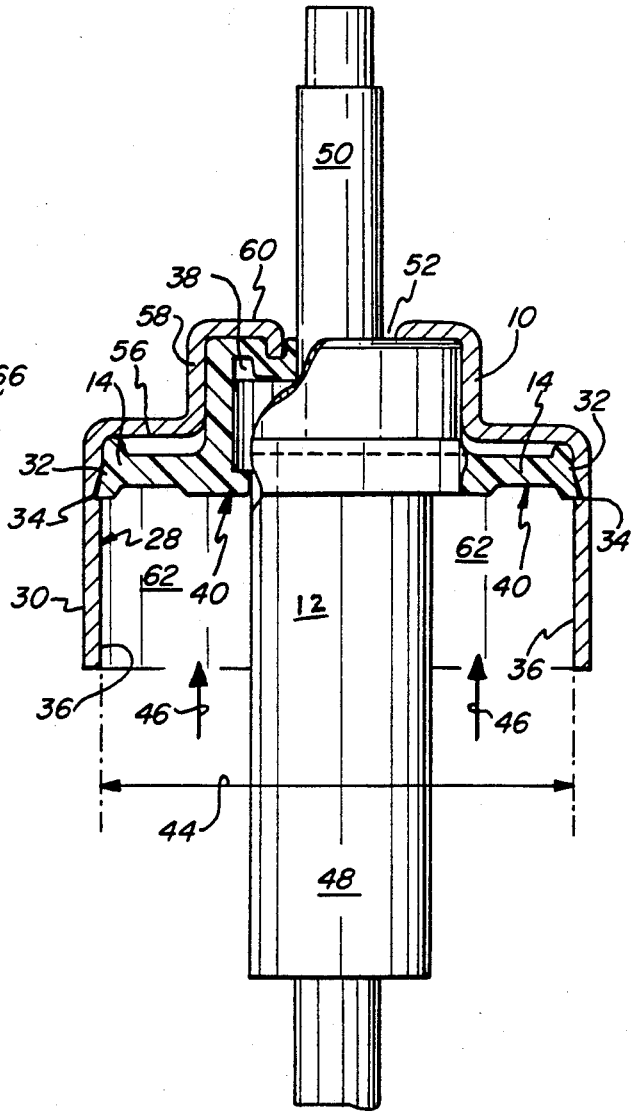
FIG. 2 is a side view with partial cross-sectional cutaway showing the mounting cup of the present invention with said sealing collar interlockingly engaged therein in a pre-assembled state before mounting onto said container.

FIG. 2 shows the mounting cup 10 of the present invention with the sealing collar 14 lockingly retained at its outer perimeter 32 in groove 34 formed in a radially inward sidewall 36 of skirt 30. Sealing collar 14 is formed with a central aperture 38 for mating with pump body 12 in a conventional fashion. Collar 14 also has a lower surface 40 for sealingly mating with upper surface 24 of flange 22. Collar 14 also has a collar diameter indicated at 42 that is slightly larger than the inside diameter 44 of cup 10, so that when collar 14 is pressed into cup 10 in the direction of arrows 46, the collar first slightly deforms radially inwardly to fit inside cup 10 and then expands radially outwardly into groove 34 to be retained in place. Collar 14 is preferably formed of a resilient polymeric material such as for example polyethylene.

Pump body 12 is generally barrel shaped and has a first end 48 for extending downwardly into container 20 and an opposite end 50 through which the contents of container 20 can be dispensed through an aperture 52 in mounting cup 10. Cup 10 also has an endwall portion 54 which is here shown with a first endwall portion 56, a stepped vertical portion 58, and a second endwall portion 60 with which skirt 30 forms a cavity 62 into which the sealing collar 14 can be received.

Figure 2A:
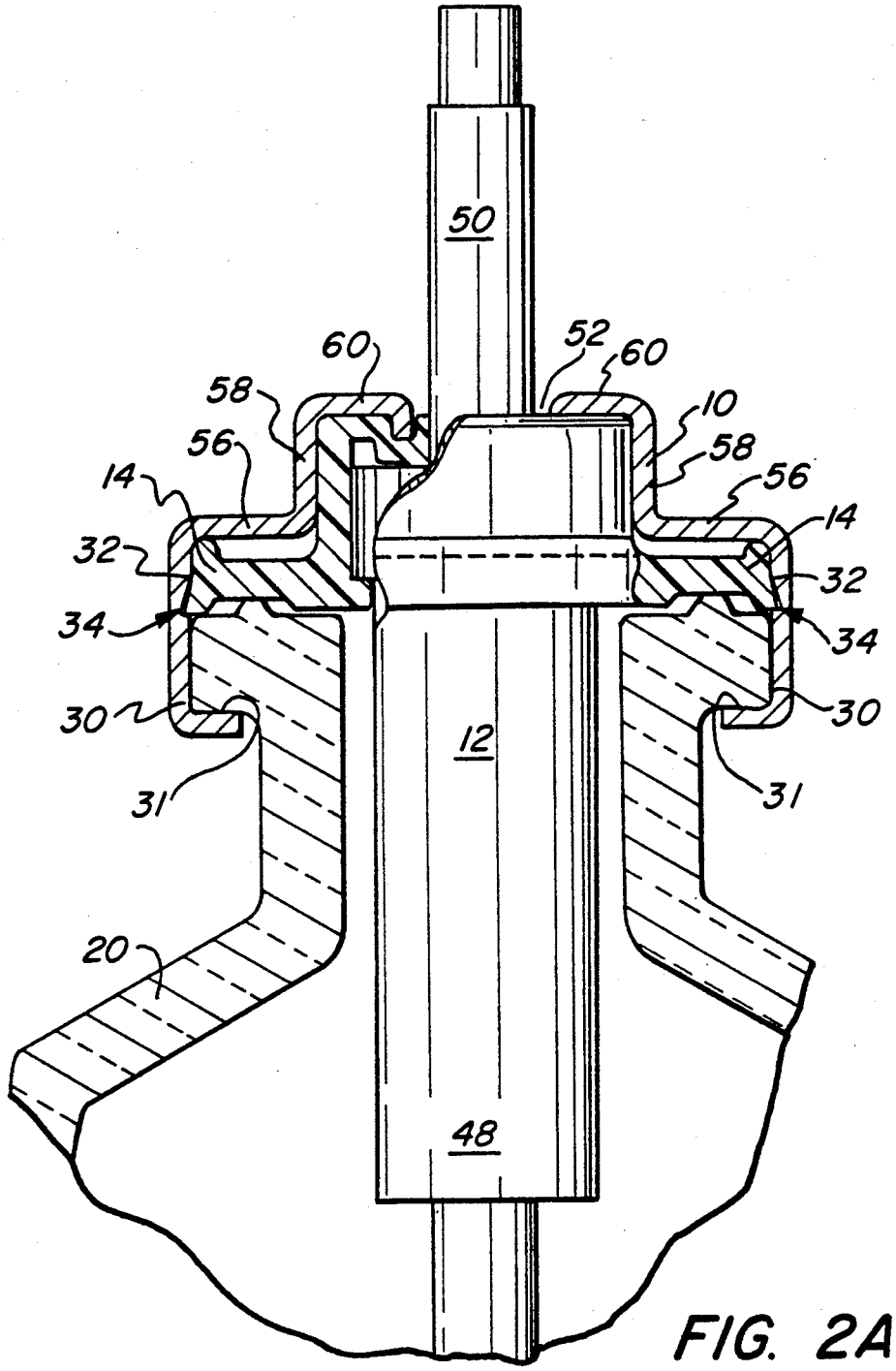
FIG. 2A is a side view with partial cross-sectional cutaway showing the mounting cup and sealing collar combination of FIG. 2 mounted into said container in an assembled state.

Cup 10 is preferably formed of a deformable material such as steel or some other metal for being crimped in a conventional manner about container flange 22 as shown in FIG. 2A, where like figure numbers correspond to identical structure in FIGS. 1 and 2. It is understood that there are methods of mounting other crimping, such as for example screwing and self attachment as disclosed in U.S. Pat. No. 4,606,479 to Van Brocklin.

It is appreciated by review of FIG. 2 that the sealing collar 14 with pump body 12 joined thereto can be reliably retained inside cup 10 by groove 34 in a preassembly state, without an undue danger that the combination may become separated until routine mounting to container 20 in a conventional sealing or crimping operation.

Figures 3, 4, 5, 6, 9:
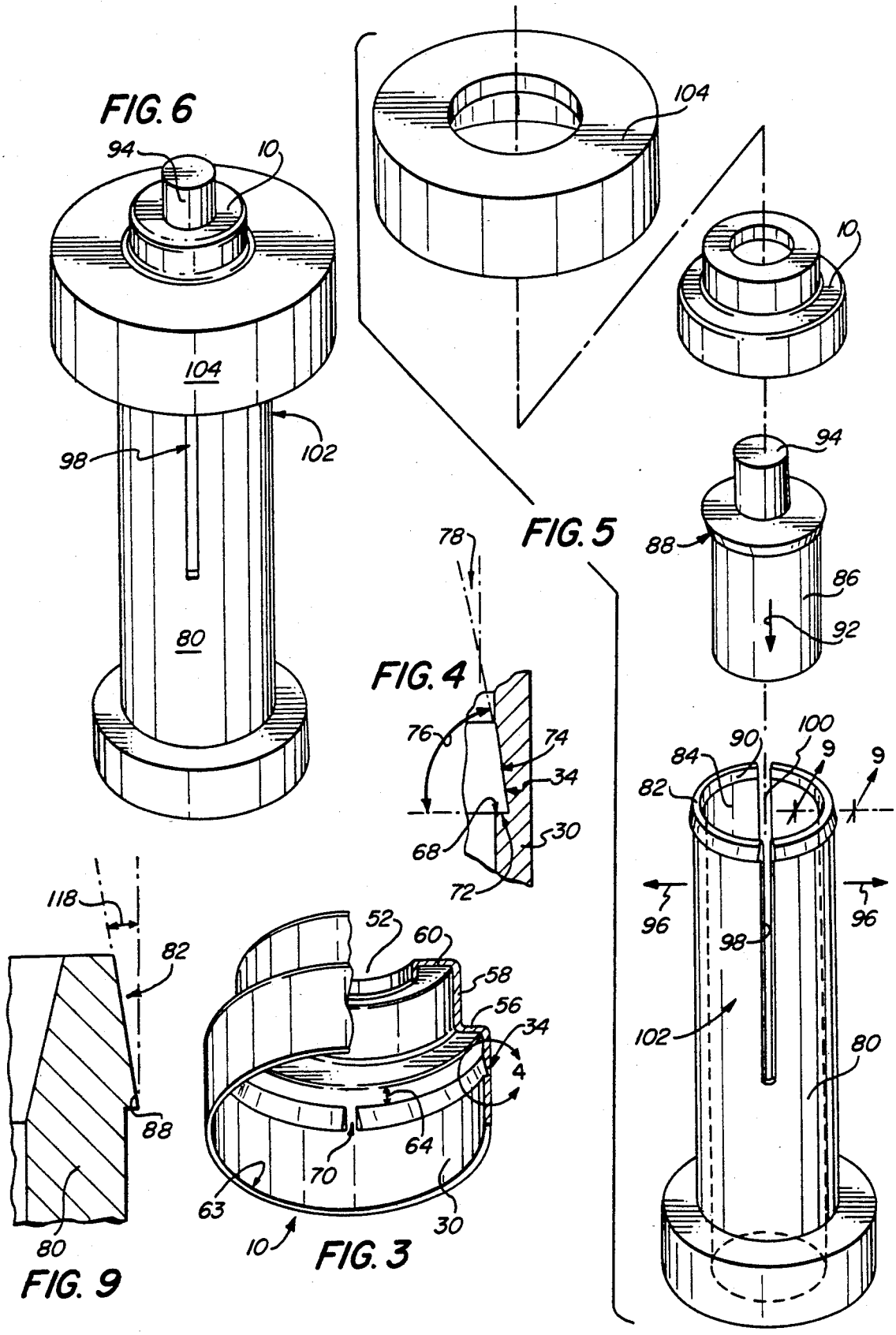
FIG. 3 shows the mounting cup of the present invention.
FIG. 4 is a cross-sectional view of the groove formed in the mounting cup of the present invention.
FIG. 5 is an exploded view of the punch and plunger set for forming the groove of FIG. 4.
FIG. 6 is the punch and plunger set of FIG. 5 shown in an assembled condition.
FIG. 9 is a cross-sectional view of the punch of the present invention as it forms the groove in the mounting cup of the present invention.

FIGS. 3 and 4 show further detail of the mounting cup 10 of the present invention. Groove 34 extends generally in a circumferential direction around the circumference 63 of cup 10 at a predetermined distance 64 from endwall portion 56, wherein distance 64 corresponds generally to the thickness 66 of collar 14 such that collar 14 will be preferably snappingly locked between endwall portion 56 and horizontally extending shelf 68 of groove 34. Distance 64 however may be greater than thickness 66, so that collar 14 can be moved further inwardly of cavity 62 but not outwardly therefrom past groove 34. It is also understood that there may be discontinuities 70 in groove 34 around circumference 63 due to groove-forming imperfections, such as for example caused by the split nature of the groove forming punch as further described below.

Groove 34 is formed by groove sidewalls 72 and 74 which preferably form an angle 76 of between about 60 and about 85 degrees. Groove sidewall 74 is also preferably at an angle 78 of about 5 degrees and about 20 degrees to the vertical, while groove sidewall 72 is preferably generally horizontal or normal to the vertical and corresponds to shelf 68.

Groove 34 is formed in mounting cup sidewall 28 by a punch and plunger set shown in an exploded view in FIG. 5. Hollow punch 80 has a blade 82 formed adjacent hollow end 84 thereof, blade 82 having a shape corresponding to the shape of the groove 34 to be formed. Plunger 86 is adapted for fitting inside hollow end 84, and plunger 86 has a radially outwardly tapered camming surface 88 for abutting against a radially inward and correspondingly tapered surface 90 on punch 80 to force blade 82 radially outwardly when plunger 86 is urged axially inward of hollow punch 80 in the direction of arrow 92, such as for example by a blow on shaped end 94 of plunger 86. The radially outward or spreading apart motion of punch 80 is indicated by arrows 96 and is facilitated by slots 98 and 100 formed in the blade end 102 of punch 80.

Mounting cup 10 receives the punch and plunger combination as further described below, and annular anvil 104 further fits around the outside of the punch and plunger assembly to provide an anvil surface against which blade 82 reacts. This punch and plunger assembly is shown further in assembled form in FIG. 6.

Figure 7:
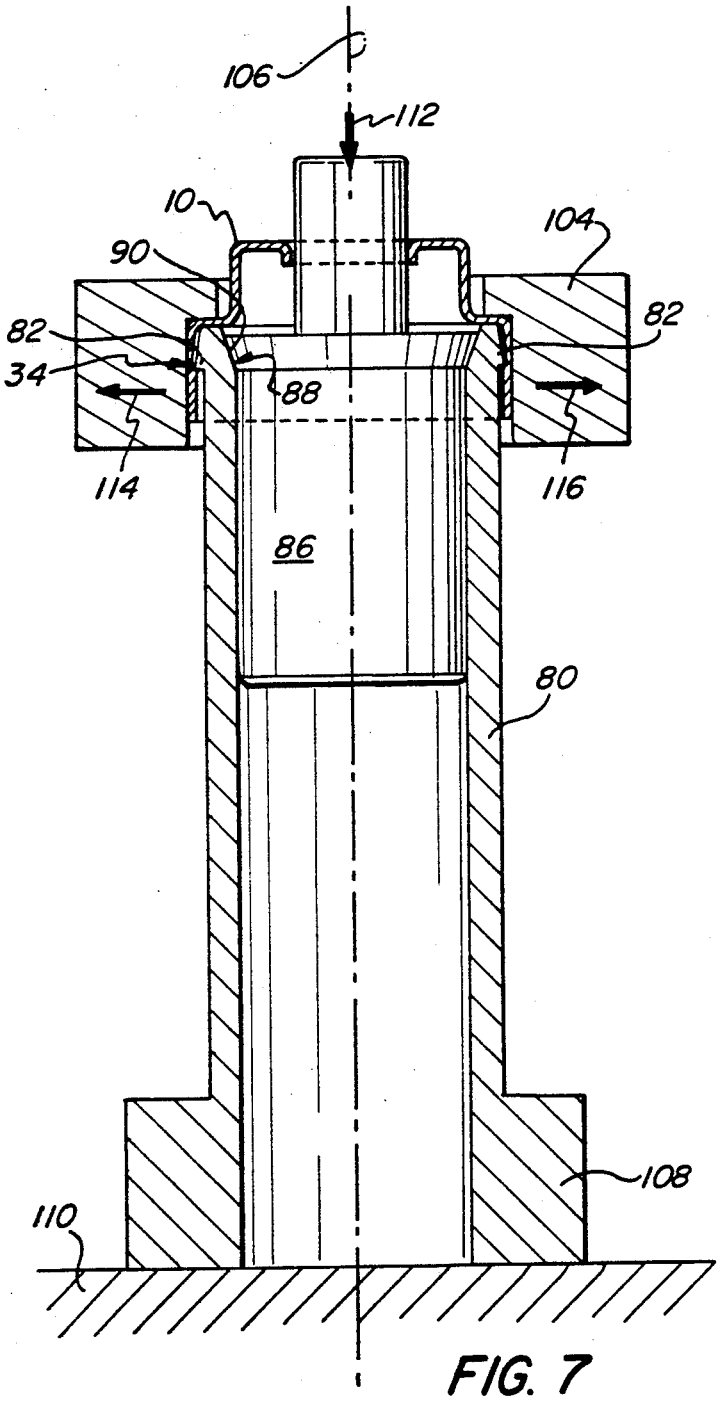
FIG. 7 is a cross-sectional view of the punch and plunger set of FIG. 6.
Figure 8:
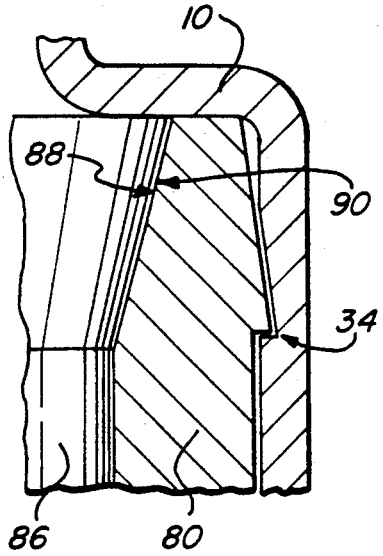
FIG. 8 is a cross-sectional view of one detail of the punch of FIGS. 5, 6, and 7.

FIG. 7 is a cross-sectional view of the assembled punch and plunger combination of FIG. 6. Plunger 86 fits inside punch 80 along central axis 106, with camming surface 88 adjacent to and in abutment with corresponding tapered surface 90. Mounting cup 10 is on the radially outward side of punch 80, and anvil 104 is further on the radially outward side of cup 10 for holding said cup 10 firmly in contact with punch blade 82. It can therefore be seen that when base 108 of punch 80 is properly supported such as against surface 110 and an inwardly axially directed force is applied as shown by arrow 112, the reaction of surfaces 88 and 90 against each other cause the blade to be urged radially outward as shown by arrows 114 and 116 to press into skirt 30 as further illustrated in FIG. 8.

In accordance with one aspect of the invention the groove 34 is visible only from the inner side of the mounting cup 10 and the appearance of the outer side of the mounting cup 10 is a continuous flush surface. As shown in FIG. 7, the continuous flush surface is provided by anvil 82 which retains the outer side of mounting cup 10 from radially outward expansion when the cup is struck with the punch 80. Thus, only the inner side of the mounting cup 10 is deformed and continuous flush surface is provided in the final product after it is assembled with a container.

FIG. 9 shows blade 82 in further detail. Surface 88 forms an angle 118 in the range of about 5 degrees to about 20 degrees.

It should be understood that various changes and modifications to the preferred embodiments described above will be apparent to those skilled in the art. Such changes and modifications can be made without departing from the spirit and scope of the present invention, and it is therefore intended that such changes and modifications be covered by the following claims.

I claim:

1. An improved mounting cup for use in mounting a sealing collar to a container having a neck with a flange including an upper surface surrounding an opening for dispensing product and an inwardly directed ledge at a lower end thereof, said collar including a resilient deformable molded polymeric material and having a central opening for receiving a dispenser to be mounted in said container through said neck, said mounting cup being formed along an axis and having an end wall extending at least partially normal to said axis for forming a cavity open to at least one end of said cup, said cup being moveable through a path of movement over said container flange to an assembled position with said cavity retaining said sealing collar therein, said mounting cup having a skirt extending from said end wall in an axial direction, said skirt having an inner sidewall facing radially inwardly for engaging a radially outward perimeter of said sealing collar, the improvement comprising:

a circumferentially extending groove formed in said sidewall around at least a portion of said sidewall at a spaced distance from said endwall, said groove for snappingly engaging said collar perimeter when said collar is inserted axially into said cavity, whereby said collar is lockingly retained in combination with said cup by the cooperation of said groove with said collar perimeter to retain said collar with said cup in a pre-assembled state before use in mounting said collar onto said flange.

2. The mounting cup of claim 1, wherein said groove is generally wedge shaped and open to said cavity.

3. The mounting cup of claim 1, wherein said groove is formed by at least a pair of groove sidewalls with one groove sidewall substantially normal to said axis, said one groove sidewall forming a shelf for interlockingly engaging said perimeter when said collar is inserted into said cavity.

4. The mounting cup of claim 1, wherein said groove extends substantially around a substantial portion of the entire inner sidewall circumference.

5. The mounting cup of claim 1, wherein said skirt has an outer sidewall that is continuous and flush.

6. The mounting cup of claim 1, wherein said cup has an inner diameter of $d_1$, said collar has a diameter of said perimeter of $d_2$, and $d_2$ is slight larger than $d_1$ to permit said collar to be retentively pressed into said groove.

7. The mounting cup of claim 3, wherein said groove is substantially V-shaped.

8. An assembly for use in sealing a container having a neck with a flange including an upper surface surrounding an opening for dispensing product and inwardly directed ledge at a lower end thereof, said assembly comprising:

(a) a sealing collar including a resilient deformable molded polymeric material and having a central opening for dispensing therethrough product from said container through said neck;

(b) a mounting cup formed along an axis and having an end wall extending at least partially across aid cup normal to said axis for forming a cavity open to at least one end of said cup, said cup being slidable through a path of movement over said container flange to an assembled position with said cavity retaining said sealing collar therein, said cup having a skirt extending from said end wall in an axial direction, said skirt having an inner sidewall facing radially inwardly for engaging a radially outward perimeter of said sealing collar, said sidewall having a circumferentially extending groove formed therein around at least a portion of said sidewall at a spaced distance from said endwall, said groove for snappingly engaging said collar perimeter when said collar is inserted axially into said cavity; and (c) a dispenser body affixed in said central opening to said sealing collar, whereby said collar and dispenser body are lockingly retained in combination with said cup by the cooperation of said groove with said collar perimeter to retain said collar with said cup in a pre-assembled state before use in mounting said collar onto said flange.

9. The mounting cup of claim 8, wherein said groove is generally wedge shaped and open to said cavity.

10. The mounting cup of claim 8, wherein said groove is formed by at least a pair of groove sidewalls with one groove sidewall substantially normal to said axis, said one groove sidewall forming a shelf for interlockingly engaging said perimeter when said collar is inserted into said cavity.

11. The mounting cup of claim 8, wherein said groove extends substantially around a substantial portion of the entire inner sidewall circumference.

* * * * *